United States Patent [19]

Eagan, Sr.

[11] 4,188,008

[45] Feb. 12, 1980

[54] FARM PUMP MOUNTING BRACKET

[76] Inventor: Joseph A. Eagan, Sr., 539 Ford St., West Conshohocken, Pa. 19428

[21] Appl. No.: 896,718

[22] Filed: Apr. 17, 1978

[51] Int. Cl.[2] ..... F16F 15/00

[52] U.S. Cl. ..... 248/544; 248/665; 248/674

[58] Field of Search ..... 248/14, 15, 16, 544, 248/565, 674; 74/242.13 R, 242.15 R; 280/457

[56] References Cited

U.S. PATENT DOCUMENTS

| | | | |
|---|---|---|---|
| 694,648 | 3/1902 | Jordan et al. | 248/16 |
| 1,275,699 | 8/1918 | Kasper | 248/16 |
| 1,894,904 | 1/1933 | De Rabot | 74/242.13 R |
| 1,960,506 | 5/1934 | Pfleger | 74/242.13 R |
| 2,689,750 | 9/1954 | Van Horn | 280/457 |
| 2,700,264 | 1/1955 | Settler | 74/242.15 R X |
| 2,764,341 | 9/1956 | Greiner | 248/16 X |
| 2,788,990 | 4/1957 | Barcafer | 280/457 |
| 2,937,885 | 5/1960 | Skow | 280/457 |
| 3,724,875 | 4/1973 | Hillman | 280/457 |
| 3,873,131 | 3/1975 | Adams | 280/457 X |

FOREIGN PATENT DOCUMENTS

| | | | |
|---|---|---|---|
| 154317 | 4/1953 | Sweden | 280/457 |

OTHER PUBLICATIONS

Fertilizer Solutions Magazine; Hylton, Jean, Fertigation–The New Promise, May–Jun., 1973.

Bulletin 275/5M, Jaeco Pump Co.

*Primary Examiner*—William H. Schultz

*Attorney, Agent, or Firm*—Weiser, Stapler & Spivak

[57] ABSTRACT

A farm pump mounting bracket comprising a split arm assembly suitable to adjustably support a mounting plate for pump supporting purposes. An adjustable safety retainer interconnects the housing of the farm pump with a portion of the body of the drive motor to prevent unrestricted mounting plate rotation in the event of drive belt failure. The bracket is sturdily constructed and employs a minimum number of operating parts.

2 Claims, 4 Drawing Figures

FARM PUMP MOUNTING BRACKET

BACKGROUND OF THE INVENTION

The present invention relates generally to the field of farm pump mounting brackets, and more particularly to a mounting bracket assembly including a safety retaining means to prevent unrestricted rotation in the event of drive belt failure.

Various types of mounting bracket assemblies for use in conveniently positioning associated machinery such as pumps in close proximity have been developed by prior workers in the art. Additionally, means for positioning a farm pump adjustably in relation to a driving well head by employing a split arm supported base has been disclosed. Variation of the positional relationships of the associated split arms has made possible variation in associated machine connections and has rendered such devices easily field adjustable. The prior art devices have generally proved satisfactory in use, but have been relatively cumbersome in construction and costly in manufacture.

Most prior art devices have been designed as fixed position units which have been attached to extend from the side walls, bolted connections, or other portions of adjacent machines. The brackets form a shelf-like extension on which associated machines such as farm pumps are situated. It has been known to fixedly attach these associated machines to the shelf or platform for usual mounting purposes whereby the pump can be driven by existing equipment such as a well head.

The adjustability of the shelf of platform has been made possible by using a variety of mechanical techniques, among which are included the split arm adjustment mechanism. The pump mounting plate has been rotatably associated with the split arm mechanisms. Such rotatable association provides even further adjustment potential and can be used for creating torque or other forces for belt tensioning.

When such combinations of split arm or other connection means are designed in rotatable association with a pump mounting plate, the drive belt is employed both to drive the pump from the well head and to maintain the platform in a generally level orientation. Breakage of the belt connecting means could result in pump damage from loss of oil. Expense and inconvenience are obvious results thereof. When part breakage occurs, the pump or other machinery secured to the platform would rotate about the supports in an uncontrolled drop. Such an occurence would cause damage both from the force of impact and from the loss of lubricating oils. Of course, should a person be near the machine at the time of belt breakage, the possibility of physical injury would be present. Thus, there remains a need to provide safety retainer mechanisms to prevent damage to machinery or personal injury in case of singel part failure.

SUMMARY OF THE INVENTION

The present invention relates generally to the field of farm pump mounting bracket assemblies, and more particularly is directed to a split arm mounting bracket having relatively simple construction including safety retaining means provided in combination therewith.

The mounting bracket of the present invention comprises a split arm assembly having a pair of arms adjustably associated in connection with a machine mounting plate. The mounting plate is rotatably fixed to the split arm assembly and safety retainer means interconnecting the machine which may be a farm pump and the affixed construction is provided. The split arm member includes a bracket support member and bracket base member which are adjustable relative to each other and to the mounting plate to permit a wide range of mounting adjustment. The principle of operation of the mounting bracket requires that the pump which is secured on the machine mounting plate and the well head each have a pulley extending in alignment with one another in position to be connected with a pump drive belt. The weight of the farm pump on the mounting plate creates a rotational force downwardly whereby a friction force is imposed on the pulley/belt interface. In the present invention, the safety retaining means is associated with the pump and with the well head to prevent uncontrolled mounting plate rotation in the event of the belt breakage. The retaining means should be strong and flexible such as a chain cable to prevent total displacement from a substantially level position should the pulley drive belt break.

The split arm assembly is affixed at one end to the well head housing to secure the mounting plate in a relatively horizontal position and to fixedly associate the mounting plate shaft in a non-movable manner. The split arm assembly includes adjustment means provided for varying the degree of angularity formed by the arm intersection to render the assembly easily field adjusted to connect to a wide variety of fixed constructions.

Rotatably associated with that end of the split arm assembly remote from the connection to the well head is the machine mounting plate which is suitably designed for securely positioning the farm pump thereon. The particular configuration of elements which comprise the rotatable interconnection is, as an element of the present invention, further described hereafter.

In a preferred embodiment, there is provided a rigid, metallic shaft which is securely affixed to an end of the split arm assembly. The shaft is positioned in a horizontal plane, and is generally perpendicular to the arm to which it is secured. The shaft and the arm are permanently joined in known manner, such as by welding or other conventional technique. Slidable along the length of the shaft are a pair of sleeves having set screw or other locking means whereby the position along the length of the shaft, once selected, may be permanently maintained. The machine mounting plate has extending therefrom a pair of eyelet members for securing the plate to the shaft in a rotatably adjustable manner. The mounting plate when fixed into position is associated with the split arm assembly by inserting the shaft through the eyelets. The eyelets are then secured in a desired position along the length of the shaft by the sleeve members which secured in the desired positions. In this way, further adjustment of the relative positions of the well head housing and associated machine mounting plate may be effected. This is particularly desirable where the machines are associated by a pulley drive and belt assembly requiring planar alignment of the respective drive and torque accepting pulleys.

The farm pump, which is belt driven from the well head, is mounted on the rotatably mounted plate and held in upright position by the pulley belt. The rotational force exerted by the weight of the pump and the mounting plate about the horizontal shaft creates a tension on the belt and provides sufficient friction for the pulley associated with the farm pump to be efficiently rotated by the well head pulley without slipping of the belt.

The present invention provides, in combination with the split arm assembly and the rotatably associated mounting plate, a safety retainer means whereby machine damage is prevented should the normal relatively horizontal position of the pump be lost by breakage of the belt. Many variations of the particular elements and embodiments of the safety retaining means are within scope of the claimed invention. In a preferred embodiment, safety cordage, such as chain, rope, flexible cable or other resilient material interconnects the farm pump housing to the well head.

It is therefore an object of the present invention to provide an improved farm pump mounting bracket of the type set forth.

It is another object of the present invention to provide a novel farm pump mounting bracket which is particularly suitable for associating a well head drive motor with a farm pump.

It is another object of the present invention to provide a novel farm pump mounting bracket assembly which employs fewer parts which greatly simplifies construction practices over prior art devices.

It is another object of the present invention to provide a novel farm pump mounting bracket assembly which has enhanced safety characteristics designed to prevent machine damage.

It is another object of the present invention to provide a novel farm pump mounting bracket assembly having an adjustable safety retaining means for preventing unrestricted rotation occasioned by belt breakage and resultant damage to machinery associated with the farm pump.

It is another object of the present invention to provide a novel farm pump mounting bracket assembly which employs operating components which utilize the retaining tension of the belt connecting the drive pulley of a well head and the pulley of the farm pump to complete the positional and force relationships required for operation.

It is another object of the present invention to provide a novel farm pump mounting bracket that is simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts through the several views, and in which:

DESCRIPTION OF THE PREFERRED EMBODIMENTS OF THE INVENTION

Figure 1:
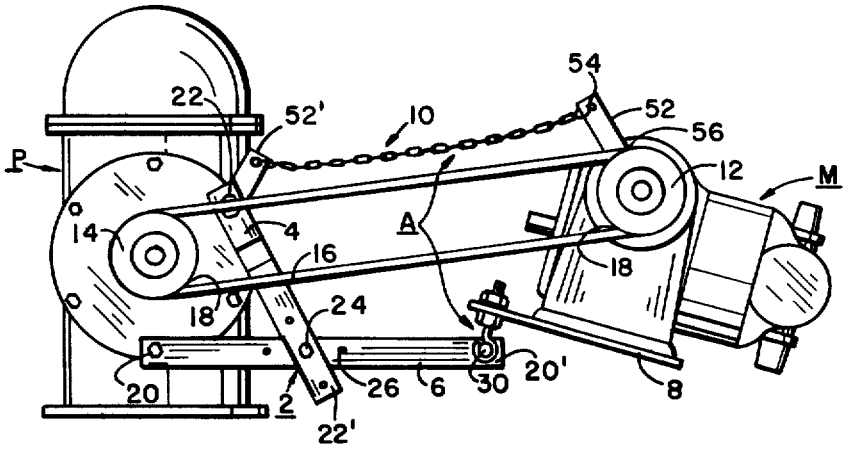
FIG. 1 is a side elevational view of a preferred embodiment of the farm pump mounting bracket assembly of the present invention.

Although specific terms are used in the following description for the sake of clarity, these terms are intended to refer only to the particular structure of the invention selected for illustration in the drawings, and are not intended to define or limit the scope of the invention.

As shown in the drawings, the mounting bracket assembly of the present invention, generally designated A, comprises a split arm assembly 2 which is adjustably associated with an existing well head housing P and a machine mounting plate 8. The mounting plate 8 is rotatably fixed to the split arm assembly 2. Safety retainer means 10 interconnects the well head housing P and the farm pump M which is fixed to the machine mounting plate 8. The split arm assembly 2 comprises a bracket support arm 4 and a bracket base arm 6 which are pivotally interconnected. The safety retaining means 10 loosely interconnects the well head housing P and a farm pump M, to prevent total displacement of the pump from its normally horizontal position. The retaining means 10 is preferably made of strong, flexible, non-breakable material such as chain, flexible cable, metal spring or the like.

Referring now to FIG. 1, the split arm assembly 2 is illustrated connected at one end to the well head housing at the flange thereof in a manner to utilize the existing flange bolts. The bracket base 6 is secured in a relatively horizontal position and is fixedly associated at its well head end 20 in a non-movable manner. The well head end 22 of the bracket support arm 4 is likewise affixed to the well head housing P at the flange thereof, but at a higher position. The bracket support arm 4 depends obliquely downwardly to create an angular intersection with the bracket base arm 6 at selected positions along its length where adjustment means 26 in the form of spaced openings are provided for varying the degree of angularity formed at the intersection. A bolt 24 or pin secures the arms 4,6 together at the desired angle. By providing a wide range of length adjustment through the use of the spaced openings 26, the same split arm assembly 2 can be made universally adjustable to adapt to mount upon a wide variety of existing equipment.

A machine mounting plate 8 is rotatably associated with the distal end 20' of the bracket base member 6 by employing a horizontal shaft 30 as hereinafter more fully set forth.

As can be seen in FIG. 1, the farm pump M, is secured on the machine mounting plate assembly 8 and is held in a relatively upright position by the drive belt 16. The farm pump pulley 12 is rotated upon rotation of the well head pulley 14 through the drive belt 16 in a conventional manner. Tension is maintained on the pulley/belt interface 18 by the combination of directed forces resulting from the positioning of the farm pump M and its weight. It will be noted that the mounting plate assembly 8 is rotatable about the shaft 30 and the weight of the mounting plate and the farm pump M normally causes counter clockwise rotational forces as viewed in FIG. 1. The belt 16 acts to prevent rotation and in turn is tensioned by rotational forces.

Figures 3, 4:
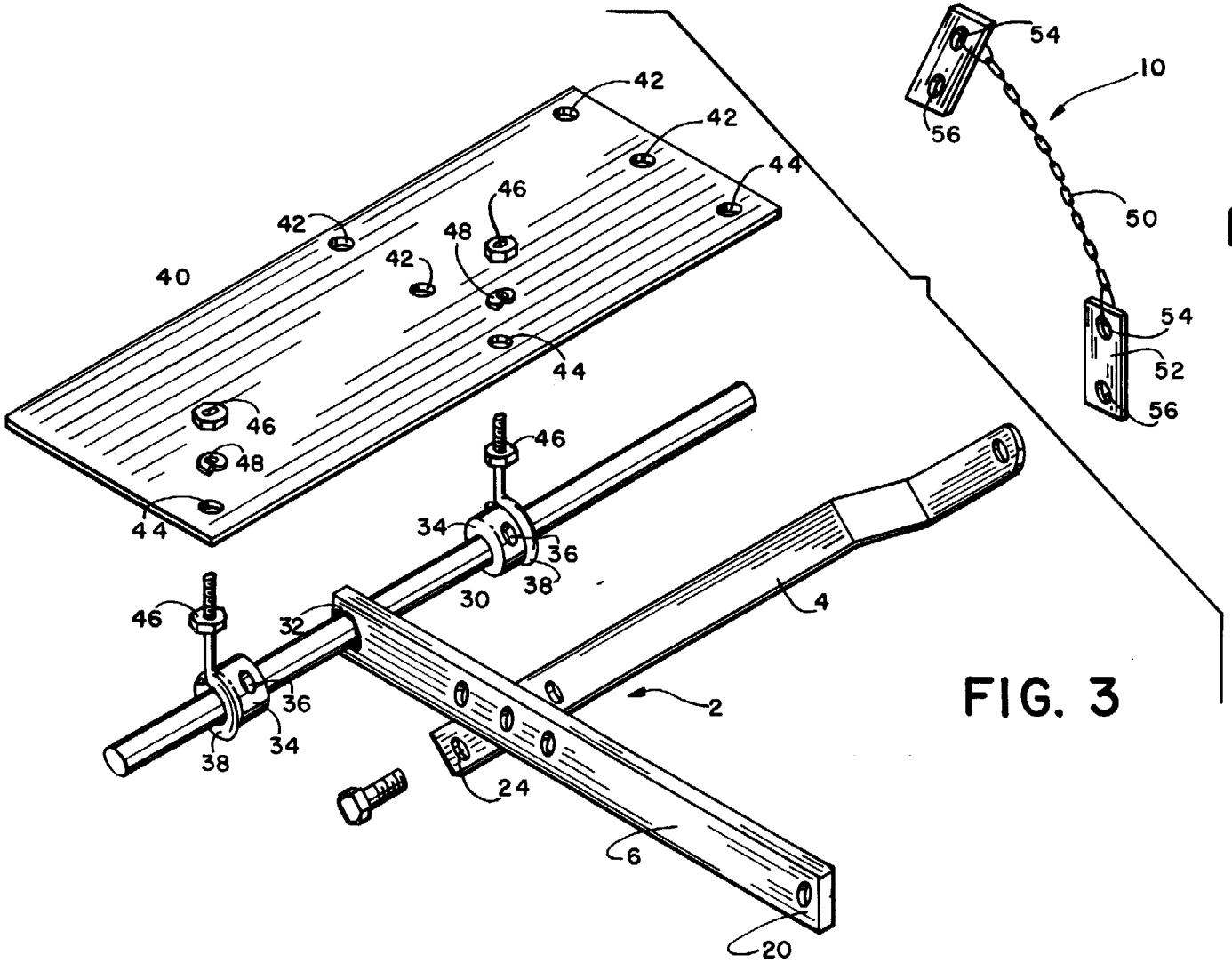
FIG. 3 is an enlarged exploded isometric view of the split arm assembly and associated rotatably mounted pump mounting plate.
FIG. 4 is an enlarged isometric view of a preferred embodiment of the safety retaining means of FIG. 1.

The safety retaining means 10 is illustrated in a embodiment comprising a safety chain 50 which loosely extends between the connecting links 52,52', which are respectively secured to upper portions of the well head housing P and the farm pump M. The connector plates 52,52' have openings 54 therethrough for connection of the safety cord or chain 50. As illustrated in FIG. 4, the other ends of the links have openings 56 therethrough for fastening to the respective machine either the well head housing P or M farm pump, with which it is associated.

Figure 2:
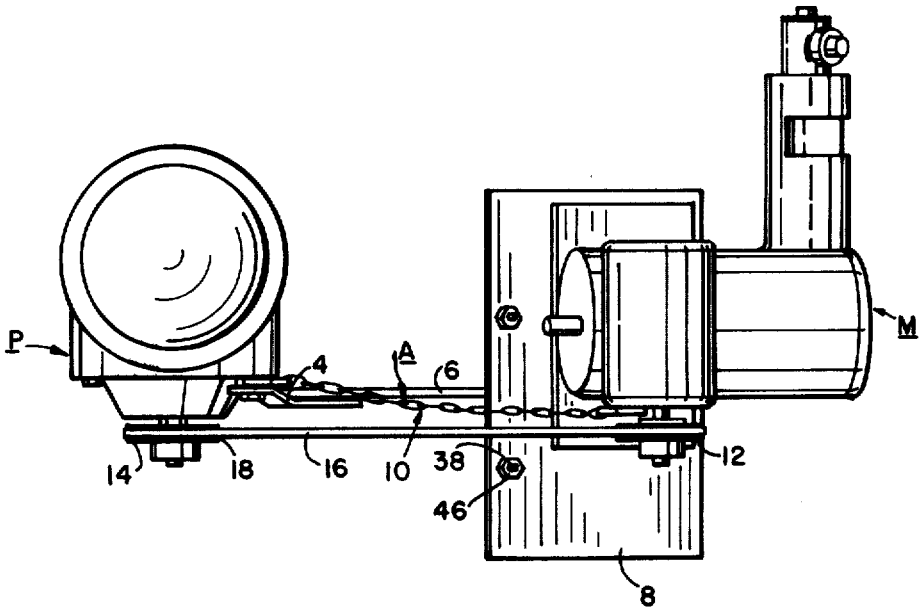
FIG. 2 is a top plan view of the farm pump mounting bracket assembly of FIG. 1.

Referring now to FIG. 1 and to FIG. 2, it is seen that the safety retaining means 10 is positioned generally parallel to and above the drive belt 16. The connecting link or plate 52' associated with the well head housing P is affixed at that same position as is the pump end 22 of support member 4 by employing the same belt. The connector plate 52, which is associated with the farm pump M, is fixed to the side wall thereof by any appropriate means such as a set screw or bolt which is secured through the opening 54.

The alignment of the drive pulley of the well head and the torque receiving pulley of the farm pump assures that even wear of the belt 16 is realized through selective adjustment by movement of the mounting plate assembly 8 on which the farm pump M is mounted longitudinally along the shaft 30.

As shown in detail in FIG. 3, the mounting plate 40 which forms a part of the assembly 8 is rotatable about the shaft 30. The shaft 30 is permanently affixed to bracket base 6 at joint 32 in known manner, for example, by welding. The welded junction 32 unifies the shaft 30 and the base arm 6 and serves to greatly simplify the construction by completely eliminating numerous interconnecting parts that prior workers had previously found necessary. The shaft 30 and base arm 6 comprise an easily adjustable, simple constructed T-shaped support suitable to readily affix the mounting bracket members to a fixed construction, such as in existing well head P. It is noteworthy that the welded connection 32 is positioned to the left of the center of the shaft 30. The off-center positioning has been found useful when adjusting the most desirable location of the mounting plate 40 (and the affixed pump M).

The rigid shaft 30 is fabricated of a weather-resistant metal or other permanent, strong material, and in manufacture, may be inserted through an opening provided in the distal end 20' of bracket base arm 6. The shaft 30 is positioned in a horizontal plane but is generally perpendicular to the longitudinal directional of the base arm 6. The shaft 30 and the base arm 6 are permanently joined at the base member opening by a welded joint 32 or other sturdy interconnection. Sleeves or collars 34 are provided at longitudinally spaced positions along the shaft 30 and are fixed into rigid association by set screws 36 to maintain the selected position. By variation of collar positions along the shaft 30, alignment of the pump pulley 12 and the drive pulley 14 is maintained.

In a preferred embodiment, the machine mounting plate 40 has extending therefrom eyelet member 38. The mounting plate 40 when fixed into position is rotatably associated with the bracket base arm 6 by inserting the shaft 30 through the eyelets 38, which can then be positioned in a desired longitudinal alignment by the sleeve members 34. Each of the eyelets 38 comprises a threaded shank which upwardly inserts through an opening 44 provided in the mounting plate 40. Suitable nuts 46 and lock washers 48 are employed to secured the eyelets to the plate 40 in the desired location.

Farm pump M is secured on the mounting plate 40 by bolts inserted through the plate openings 42 held in position in generally horizontal orientation by the resilient strength of the drive belt 16. The rotational force exerted by the downward force vector of the farm pump about the shaft 30 creates a tension on the pulley belt 16, thereby giving sufficient friction for the farm pump and pulley 14 to be efficiently rotated without slippage of the belt 16.

As seen in FIG. 4, the safety retaining means is comprised of a flexible safety cordage 50 having a connector plate 52, 52' at either end thereof. Each end of the safety cordage is fixed to a connector plate 52,52' through openings 54. At the opposite end of each of the connector plates 52,52' is a machine fastening opening 56 through which the safety retaining means 10 is made fast the well head P and farm pump M.

As is best contemplated by the inventor at the present time, the principle of operation of the mounting bracket assembly and safety retaining means requires the farm pump M which is mounted on machine mounting plate 40, and the well head housing P each have a pulley 12, 14 extending in alignment with one another so as to be connected with the drive belt 16. Thus, the rotative association of the mounting plate assembly 8 to the fixedly adjustable split arm assembly 2 creates a rotational force downwardly whereby a frictional force is imposed on the pulley/belt interface 18.

The rotational force exerted by the weight of the farm pump M and the plate 40 creates a tension on the belt 16 of sufficient friction to assure that the farm pump will be efficiently rotated by the well head pulley 14 without slipping of the belt 16.

The amount of tension placed on the drive belt 16 may be predetermined by selectively adjusting the relative positions of the bracket base arm 6 and the bracket support arm 4. By associating selected force components, an equilibrium can be established requiring the preselected amount of tension on the pulley belt 16 for equalization.

The safety retaining means 10 operates to prevent, in case of drive belt breakage, the complete displacement of the farm pump M by rotation of the mounting plate 40 downwardly. Thus, the tension holding the farm pump M in relative upright position requires the resilience and strength of a chain or other shock-absorbing durable material.

It is evident that the usefulness of the safety retaining means 10 is not only economic in terms of its simplicity of design and construction, but also in preventing the destruction of expensive machinery.

Although the invention has been described with a certain degree of particularity, it is understood that the present disclosure has been made only by way of example and that numerous changes in the details of construction and the combination and arrangement of parts may be resorted to without departing from the scope of the invention.

What is claimed is:

1. A mounting bracket assembly for use in conveniently positioning a farm pump associated with a well head which comprises:

a split arm assembly fixed to said well head, said assembly comprising a pair of arms which are pivotally interconnected, a mounting assembly having portions thereof rotatably associated with said split arm assembly, said mounting assembly comprising a fixed shaft and a mounting plate rotatable about the shaft;

safety retaining means to interconnect said farm pump and said well head;

eyelet means having a fixed end secured to the mounting plate and an eyelet end the size to overfit the shaft to facilitate rotation of the mounting plate about the shaft; and sleeve members or collars on the shaft whereby the sleeve members serve to longitudinally position the mounting plate relative to the shaft by limiting movement of the eyelet means relative to the shaft.

2. The mounting bracket assembly of claim 1, wherein said sleeve members or collars have locking means for fixing the sleeve members into position along the shaft.

* * * * *